United States Patent [19]

Guy

[11] Patent Number: 4,823,144

[45] Date of Patent: Apr. 18, 1989

[54] APPARATUS FOR TRANSMITTING AND/OR RECEIVING MICROWAVE RADIATION

[75] Inventor: Ronald F. E. Guy, Maldon, England

[73] Assignee: The Marconi Company Limited, Stanmore, United Kingdom

[21] Appl. No.: 443,067

[22] Filed: Nov. 19, 1982

[30] Foreign Application Priority Data

Nov. 27, 1981 [GB] United Kingdom ..... 8135948

[51] Int. Cl.[4] ..... H01Q 21/22

[52] U.S. Cl. ..... 343/853; 342/375

[58] Field of Search ..... 343/853, 375, 368, 410, 343/844, 700 MS, 768, 771

[56] References Cited

U.S. PATENT DOCUMENTS

| | | | |
|---|---|---|---|
| 3,124,802 | 3/1964 | Von Dallarmi | 343/853 |
| 3,845,490 | 10/1974 | Manwarren et al. | 343/853 |
| 3,903,524 | 9/1975 | Giannini | 343/853 |
| 3,964,067 | 6/1976 | Lucas | 343/853 |
| 4,041,501 | 8/1977 | Frazita et al. | 343/844 |
| 4,117,494 | 9/1978 | Frazita | 343/368 |
| 4,342,997 | 8/1982 | Evans | 343/853 |

*Primary Examiner*—William L. Sikes
*Assistant Examiner*—Michael C. Wimer
*Attorney, Agent, or Firm*—Spencer & Frank

[57] ABSTRACT

A microwave radiating system including an antenna composed of a plurality of vertically spaced elements and circuit members connected to feed the elements in a manner such that the amplitude of the energy distribution among the elements and the second derivative of the phase variation in the vertical direction of the antenna each have a maximum between the bottom and the center of the antenna.

6 Claims, 3 Drawing Sheets

APPARATUS FOR TRANSMITTING AND/OR RECEIVING MICROWAVE RADIATION

BACKGROUND OF THE INVENTION

This invention relates to apparatus for transmitting and/or receiving microwave radiation comprising means for generating signals at microwave frequency, an antenna having individual elements arranged at progressively higher levels, and means for feeding the signals to the individual elements in such a way that the amplitudes and phases of the signals at the individual elements cause the antenna to have a gain which is relatively low at negative elevation angles (i.e., angles below the horizontal); which rises steeply to a maximum at a low positive elevation angle; and falls (preferably relatively slowly and at a progressively decreasing rate) towards higher elevation values.

The need for a gain distribution in the vertical plane as described above is apparent from FIGS. 1 and 2. FIG. 1 is a schematic illustration which assumes an antenna to be located at the origin. This antenna forms part of a radar system at an airport to detect aircraft within a given horizontal range (d) and below a maximum height (h). It is not required to detect aircraft at elevation angles higher than 35°. Thus, the shaded area of FIG. 1 indicates the region, in vertical plane, that it is designed to survey. This requirement for a radar to survey an area like that shown shaded on FIG. 1 is typical for radars required to monitor the activities of aircraft in the region of an airport and gives rise to the need for a radar antenna having a gain which varies with elevation in a manner as shown by a solid line in FIG. 2. It is not detrimental if the gain is higher than the required value (i.e., above the solid line of FIG. 2) at positive elevation angles. It is however a disadvantage for the gain to be above a specified level (ideally zero) at a negative elevation angle since, if it were, a substantial amount of radiation would be transmitted onto the ground and cause the radar to respond to signals transmitted and/or received indirectly by reflection off the ground.

An approximation to the gain distribution in the vertical plane, as illustrated by the solid line of FIG. 2, has generally been achieved in the past using a method called Woodward Synthesis to calculate appropriate phase and amplitude values to be applied to individual elements of an antenna. Using the Woodward method one might typically design the antenna so that the amplitude and phase distributions are as shown in dot-dash lines in FIGS. 3A and 3B: assuming that the antenna elements are located in a vertical plane. It should be explained here that it is not essential that the antenna elements be located in a vertical plane. They could be located in a sloping plane as will be described later.

Referring now to FIG. 3A, and in particular to the dot-dash line therein, it is notable that, using Woodward Synthesis, the amplitude increases at an increasing rate in lower and upper base regions of the antenna, reaches and falls from a peak in a central region, and drops at a decreasing rate towards the top of the antenna.

Referring now to FIG. 3B it will be seen that, again using the Woodward technique, indicated by the dot-dash line, the phase lag, relative to a reference, is also generally symmetrical about the centre of the antenna. In a central region it rises relatively rapidly, whilst in the top and base regions it rises relatively slowly. The curve thus has two distinct bends indicated at 1 and 2 in the central region where the second derivative of phase with respect to height has peaks.

The amplitude and phase distributions, e.g., as shown in FIGS. 3A and 3B, calculated according to the Woodward method, typically give a gain distribution somewhat as shown by the dot-dash line in FIG. 2. From FIG. 2 it will be noted that this gain distribution features a high side lobe 3 at a negative elevation angle. It also features one or more troughs 4 which fall below a $CSC^2$ part 5 of the ideal curve.

SUMMARY OF THE INVENTION

The inventor has discovered that a better approximation to the desired gain distribution can be achieved by producing gain and phase distributions (in a vertical plane adjacent the antenna) as shown by the solid lines on FIGS. 3A and 3B. Referring to the solid line of FIG. 3A it will be seen that the new amplitude distribution is no longer symmetrical about the centre but has a major peak in the upper half of the base region and a lesser peak in the central region. Referring to FIG. 3B, the phase distribution also is no longer symmetrical about the centre. The phase increases at a relatively low rate in the lower half of the base region, and at a relatively high rate in the central and top regions. In the upper half of the base region, roughly coincident with the major amplitude peak, there is a sharp bend in the phase distribution i.e., the second derivative of the phase with respect to height has a maximum. In the central region and top region the slope of the curve, i.e., the rate of increase of phase lag, progressively increases, decreases, increases again and then decreases again.

By using the amplitude and phase distributions as shown in FIGS. 3A and 3B, it has been found possible to achieve antenna gain characteristics generally as shown by the dotted line of FIG. 2. This has a side lobe 3' considerably lower than the side lobe 3 achieved using the Woodward method. Also it has troughs 4' which penetrate considerably less below the ideal line 5 than did the trough 4 of the Woodward method. These improvements can be achieved without using either a larger antenna nor more elements nor greater power consumption.

Having regard to the foregoing the invention provides apparatus for transmitting microwave radiation comprising: means for generating signals at microwave frequency; an antenna having individual elements arranged at progressively higher levels; and means for feeding the signals to the individual elements in a manner such that the amplitude of the energy and the second derivative of phase with respect to height are each at a maximum between the bottom and the centre of the antenna.

The invention also provides apparatus for transmitting microwave radiation comprising an antenna having individual elements arranged at progressively higher levels and means for feeding energy to the individual elements in a manner such that in a vertical plane immediately at the front of the antenna having a lower base region, an upper base region, a central region and a top region, said regions being one above and adjacent another in that order and considering progressively higher portions of said plane: the amplitude of energy transmitted from the antenna increases in the lower base region, reaches and falls from a first peak in the upper base region, reaches and falls from a second peak in a central region and falls in the top region; whilst the phase lag of said energy relative to a reference increases with respect to height relatively slowly in the lower base region, attains a relatively high rate of increase with respect to height in the upper base region, and maintains a relatively high rate of increase with respect to height in the central and top regions.

It will be understood that any apparatus for transmitting microwave radiation can also be used for receiving microwave radiation. Thus, for the purposes of this specification, and for simplicity of description it is to be understood that an apparatus designed particularly for receiving but not for transmitting radiation is to be considered as a transmitter even though it might not be particularly intended for that purpose.

DESCRIPTION OF THE PREFERRED EMBODIMENTS

Figure 1:
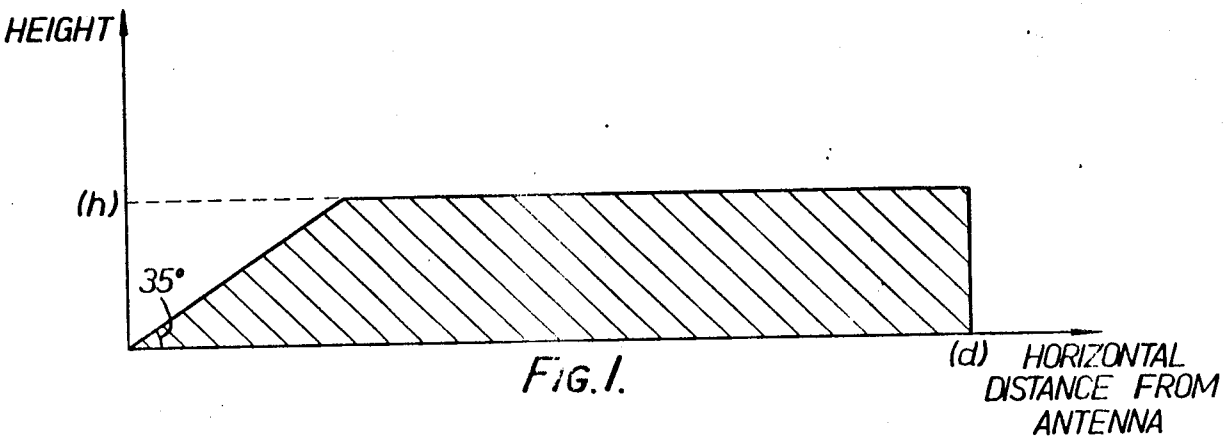
FIG. 1 is a schematic pictorial view of a desired antenna coverage pattern, and has already been described.
Figure 2:
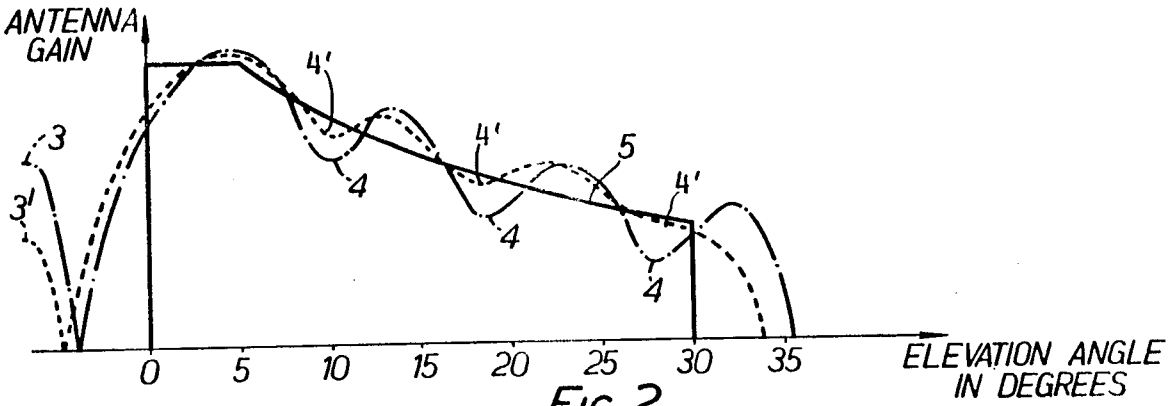
FIG. 2 is a diagram illustrating several antenna gain characteristics, and has already been described.

One particular way of performing the invention will now be described by way of example, with reference to FIGS. 2, 3A and 3B already mentioned and with reference to FIGS. 3C and 4. FIG. 4 illustrates the top region of an antenna, shown partly broken away, constructed in accordance with the invention and arranged with individual Dipole radiators located in a plane at 12° to the vertical. It is designed to produce an amplitude and phase distribution as shown by the solid line of FIG. 3B, the phase distribution in the plane of the Dipoles being as shown in FIG. 3C. Referring now to FIG. 4 there are a number of triplates 6, 6A, 6B, etc., which are similar to each other, only one of them, namely triplate 6, being described. This has a central conductor 7 separated by dielectric layers 8 and 9 from outer conductors 10 and 11. The dielectric layer 9 is deposited over the conductive layer 7 after it has been etched into the form illustrated.

The central conductor 7 defines a common feed line 1A onto which energy is fed from a power source, or signal generator, 20 and travels in the directions indicated by the arrows. A respective branch line 12 leads from the common feed line 1A to each individual element 13 located at the edge of the triplate and in a plane which makes an angle of 12° to the vertical. There are ten elements 13 on this particular triplate.

At each intersection of the main feed line 1A with the branch line 12 is a step transformer 14 which distributes a required proportion of the received energy to the appropriate branch line. The branch lines contain loops so that energy arrives at each element at the required phase. Each element 13 couples the energy to a pair of associated dipole radiators 15 formed by shaped edges of the ground planes 10 and 11.

Figure 3A:
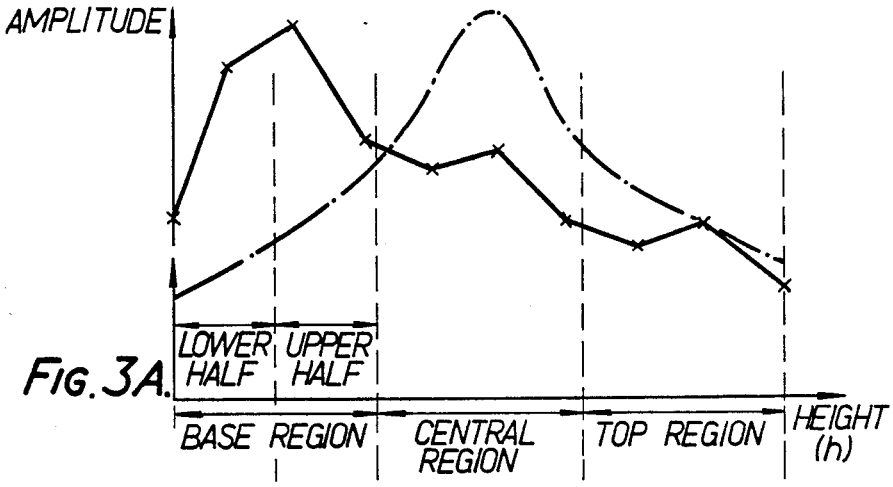
FIGS. 3A, 3B and 3C are diagrams illustrating various antenna operating characteristics, and have already been described.
Figure 3B:
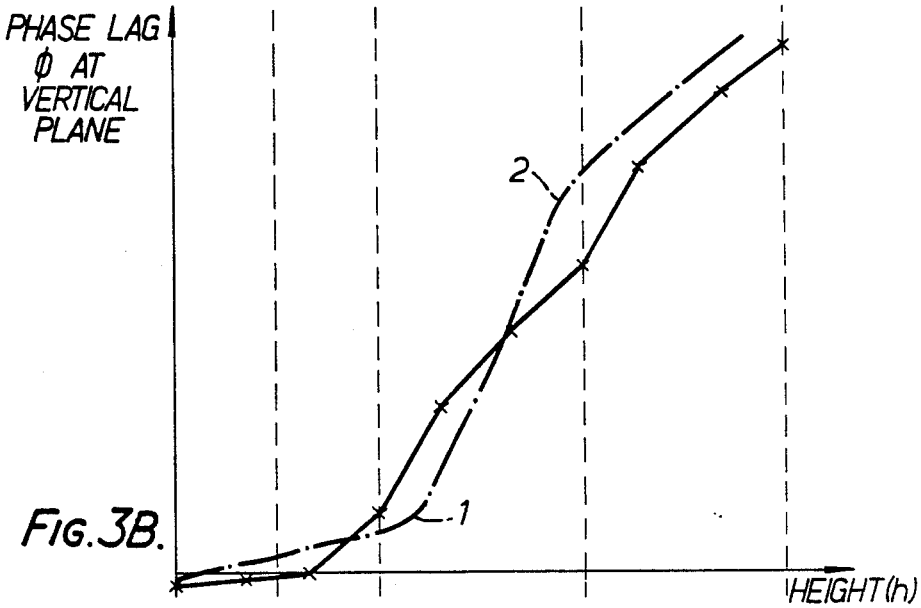
Figure 3C:
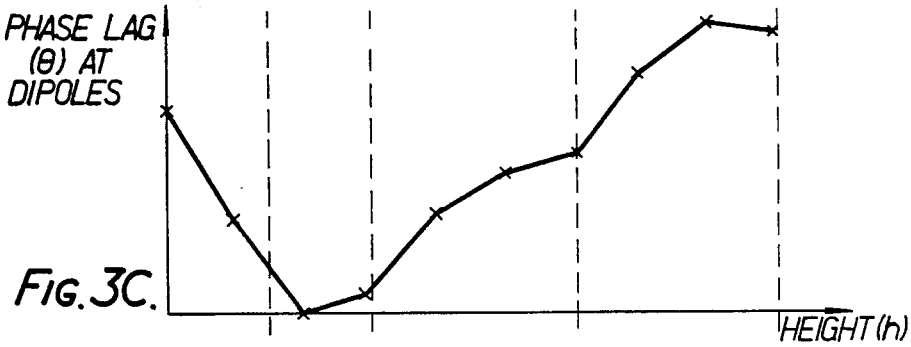
Figure 4:
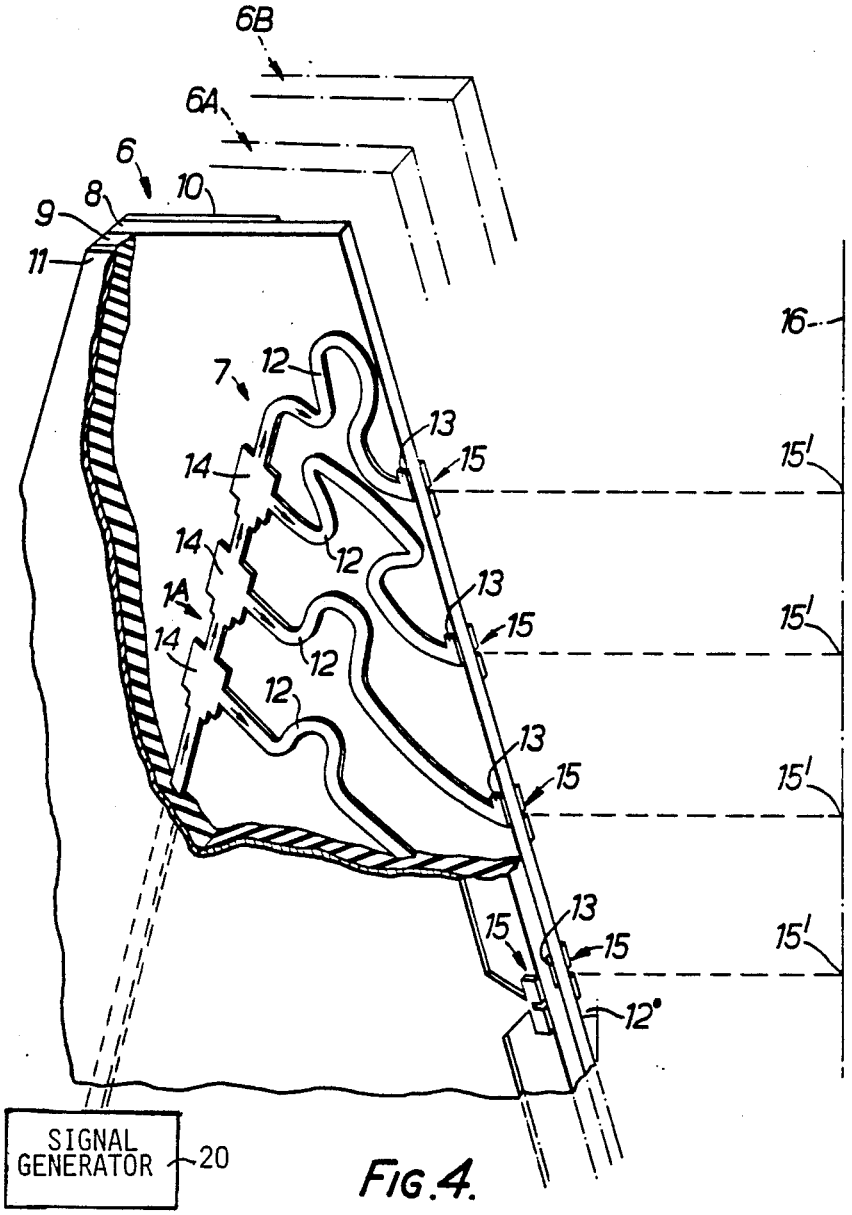
FIG. 4 is a perspective, elevational, partly broken-away view of the top region of one component of an antenna according to a preferred embodiment of the invention.

The distributions of amplitude and phase at the dipoles 15 is as shown by solid lines in FIGS. 3A and 3C, the crosses on the curves indicating the values at respective elements 15. The distributions of amplitude and phase at a vertical plane 16 shown in FIG. 4 is as shown by solid lines in FIGS. 3A and 3B where the crosses indicate positions 15' at the same vertical heights as the dipoles 15.

The dipoles 15 shown in FIG. 4 are arranged in a plane at an angle to the vertical because this reduces the required phase distribution over the whole antenna. This is apparent from a comparison of FIGS. 3B and 3C which shows that the required phase distribution is almost halved. There are other advantageous reasons for the non-vertical arrangement. For example, it allows the dipoles to be spaced at a considerably greater distance apart thereby facilitating the arrangement of loops in branch lines 12.

I claim:

1. Apparatus for transmitting microwave radiation comprising means for generating signals at microwave frequency; and antenna having a top, a bottom and a center located between said top and bottom, with said top being positioned above said bottom when said antenna is in operation, so that said antenna has a length dimension extending between said top and said bottom, said antenna including individual elements spaced apart in the direction of said length dimension; and signal feeding means for feeding the signals from said signal generating means to the individual elements for causing said antenna to radiate energy, said signal feeding means comprising signal amplitude control means operatively associated with said elements for controlling the amplitude of the signals fed to each said element in a manner such that the amplitude of the energy radiated by said antenna has a first peak between the bottom and the centre of the antenna, and signal phase control means operatively associated with said elements for controlling the relative phase of the signals fed to each said element in a manner such that the second derivative of the phase of the energy radiated by said antenna, with respect to height as measured along a vertical line, has a first peak between the bottom and the centre of the antenna.

2. Apparatus according to claim 1 wherein the amplitude has a second peak lower than said first peak at a position at the centre of the antenna.

3. Apparatus according to claim 2 wherein the amplitude has minimum values at positions adjacent said top and bottom of said antenna.

4. Apparatus according to claim 1 in which the antenna gain is relatively low at negative elevation angles, below the horizontal, rises steeply to a maximum at a low positive elevation angle, and falls at a progressively decreasing rate towards higher elevation angles.

5. Apparatus according to claim 1 in which different antenna elements have different transmission lines along which they receive energy from a common source, the transmission lines being of different lengths chosen so that there is a phase difference between different elements.

6. Apparatus for transmitting microwave radiation comprising: means for generating signals at microwave frequency; an antenna having a top and bottom and including individual elements spaced apart along said antenna between said top and bottom, said antenna being composed, proceeding in order from said bottom to said top, of a lower base region, an upper base region, a central region, and a top region, said regions being one above and adjacent another in that order; and signal feeding means connected for feeding the signals from said signal generating means to the individual elements for causing said antenna to radiate energy, said signal feeding means comprising signal amplitude control means operatively associated with said elements for controlling the amplitude of the signals fed to each said element in a manner such that, proceeding in the direction from said bottom to said top, the amplitude of energy radiated from the antenna increases in the lower base region, reaches and falls from a first peak in the upper base region, reaches and falls from a second peak in the central region, and falls on average in the top region, and signal phase control means operatively associated with said elements for controlling the relative phase of the signals fed to each said element such that, proceeding upwardly in the vertical direction, the phase lag of said energy relative to a reference increases relatively slowly in the lower base region, attains a relatively high rate of increase in the upper base region, and maintains a relatively high rate of increase in the central and top regions.

* * * * *